US009272225B2

(12) United States Patent
Gunter et al.

(10) Patent No.: US 9,272,225 B2
(45) Date of Patent: Mar. 1, 2016

(54) CRIB SOOTHER

(75) Inventors: Matthew Jay Gunter, Atlanta, GA (US); Bradford Reese, Decatur, GA (US)

(73) Assignee: KIDS II, INC., Atlanta, GA (US)

( * ) Notice: Subject to any disclaimer, the term of this patent is extended or adjusted under 35 U.S.C. 154(b) by 189 days.

(21) Appl. No.: 13/612,229

(22) Filed: Sep. 12, 2012

(65) Prior Publication Data

US 2013/0065478 A1 Mar. 14, 2013

Related U.S. Application Data

(60) Provisional application No. 61/534,098, filed on Sep. 13, 2011.

(51) Int. Cl.
*A63H 33/00* (2006.01)
*A63H 5/00* (2006.01)
*A63H 33/22* (2006.01)

(52) U.S. Cl.
CPC ..... *A63H 5/00* (2013.01); *A63H 33/006* (2013.01); *A63H 33/22* (2013.01)

(58) Field of Classification Search
USPC ..... 446/219, 227, 242; 434/303, 308, 314; 362/35, 97.1, 101, 269; 472/61
See application file for complete search history.

(56) References Cited

U.S. PATENT DOCUMENTS

| | | | | | |
|---|---|---|---|---|---|
| 2,118,264 | A * | 5/1938 | Nanfeldt | 472/61 |
| 2,821,393 | A * | 1/1958 | Hoppe | 472/61 |
| 4,085,932 | A * | 4/1978 | Hamano | 472/61 |
| 4,197,671 | A * | 4/1980 | De Brouwer | 446/242 |
| 4,373,918 | A * | 2/1983 | Berman | 434/307 R |
| 4,591,955 | A * | 5/1986 | Kallay | 362/101 |
| 4,985,811 | A * | 1/1991 | Weiner | 362/101 |
| 5,205,636 | A * | 4/1993 | Carpenter | 362/84 |
| 5,324,224 | A * | 6/1994 | Anderson et al. | 446/91 |
| 5,406,729 | A * | 4/1995 | Bejin | 40/433 |
| 5,446,934 | A | 9/1995 | Frazier | |
| 5,515,631 | A * | 5/1996 | Nardy et al. | 40/518 |
| 5,738,587 | A * | 4/1998 | Dykstra | 472/61 |
| 5,944,574 | A * | 8/1999 | Small et al. | 446/149 |
| 5,951,405 | A * | 9/1999 | Eigenmann | 472/61 |
| 6,055,753 | A * | 5/2000 | Sondericker, III | 40/471 |
| 6,084,527 | A | 7/2000 | Spector | |
| 6,116,983 | A * | 9/2000 | Long et al. | 446/227 |
| 6,219,183 | B1 * | 4/2001 | Doany | 359/450 |
| 6,365,881 | B1 * | 4/2002 | Itzhak | 219/481 |
| 6,385,881 | B1 * | 5/2002 | Hess | 40/428 |
| 6,612,935 | B2 * | 9/2003 | Rojahn | 472/61 |
| 6,681,508 | B2 * | 1/2004 | Unger et al. | 40/406 |
| 6,812,822 | B1 | 11/2004 | Spector | |
| 7,049,968 | B2 * | 5/2006 | Fitzgerald et al. | 340/573.1 |
| 7,101,184 | B2 * | 9/2006 | Kirchhoff | 434/88 |
| 7,219,456 | B1 * | 5/2007 | Wei et al. | 40/428 |
| 7,727,078 | B2 | 6/2010 | Arnold, IV et al. | |
| 7,770,312 | B2 * | 8/2010 | Stinson et al. | 40/428 |
| 7,874,679 | B2 * | 1/2011 | Stonier | 353/10 |
| 7,927,171 | B2 * | 4/2011 | Goszewski et al. | 446/227 |
| 8,234,803 | B2 * | 8/2012 | Gallo et al. | 40/428 |
| 2008/0120882 | A1 * | 5/2008 | Mueller | 40/714 |
| 2008/0181587 | A1 * | 7/2008 | Patil et al. | 392/348 |

* cited by examiner

*Primary Examiner* — Kurt Fernstrom
(74) *Attorney, Agent, or Firm* — Gardner Groff Greenwald & Villanueva, PC

(57) ABSTRACT

A soother device for calming infants and children and inducing sleep. The soother includes a light source and a rotating image bar through which light from the source is projected to generate a soothing light pattern visible to the infant or child, for example in wave form or having the appearance of moving water or light reflecting from moving water.

35 Claims, 5 Drawing Sheets

CRIB SOOTHER

CROSS-REFERENCE TO RELATED APPLICATION

This application claims the priority benefit of U.S. Provisional Patent Application Ser. No. 61/534,098 filed Sep. 13, 2011, the entirety of which is hereby incorporated herein by reference for all purposes.

TECHNICAL FIELD

The present invention relates generally to the field of children's accessories, and more particularly to a calming device for generating visible light patterns for soothing and calming infants and/or children.

BACKGROUND

Some infants and children have difficulty falling asleep or sleeping on a regular schedule. It has been discovered that certain visible images or patterns may have a calming effect on infants and children. It is to the provision of a crib soother device for attachment to or around a crib or other sleeping area to generate visible light patterns or images to help calm infants and children, that the present invention is primarily directed.

SUMMARY

In example embodiments, the present invention provides a soothing device for infants and/or children that produces visual patterns of light in calming patterns, such as waves or smoothly undulating patterns, for example simulating the appearance of moving water or light reflected from rippling water. In example forms, light is projected from at least one light source onto or through an image rod. The image rod and/or the light source move relative to one another, for example in a smooth and continuous rotational and/or translational relative motion, to vary the pattern of light reflected from and/or transmitted through the image rod. One or more mirrors, reflectors, lenses or other optical elements are optionally provided to direct and/or alter the projection of resultant light patterns. Optionally, the brightness, color and/or intensity of light from the light source(s) is/are varied. One or more audible sound patterns optionally are generated, for example at varying frequencies and/or amplitude, in combination with, and optionally in synchronization with the varying light patterns, to promote a soothing and calming sensation. In example form, sounds of water flowing, ocean waves, or the like are simulated in combination with light patterns simulating moving water or the reflection of light from moving water.

In one aspect, the present invention relates to a child soothing apparatus preferably including a light source and an image bar, the image bar being movable relative to the light source to generate a varying visible light pattern having a soothing effect on an observer.

In another aspect, the present invention relates to a soother device preferably including a housing defining a window, wherein a display surface is visible through the window of the housing. The soother device preferably also includes a light source mounted within the housing, an image bar rotationally mounted within the housing, and a motor for rotating the image bar. Light is preferably transmitted from the light source through the rotating image bar and onto the display surface to generate a light pattern.

In still another aspect, the present invention relates to a soother device preferably including a plurality of light sources arranged in a generally linear array. The soother device preferably also includes an elongate image bar defining a lengthwise axis generally parallel to the linear array of light sources, the image bar at least partially comprising a light transmissive material, and further comprising at least one pattern generating element having a different light transmissivity than the light transmissive material. The soother device preferably also includes a motor for rotating the image bar about the lengthwise axis, and a display surface onto which a changing light pattern is displayed, the changing light pattern being generated by transmission of light from the plurality of light sources though the rotating image bar.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
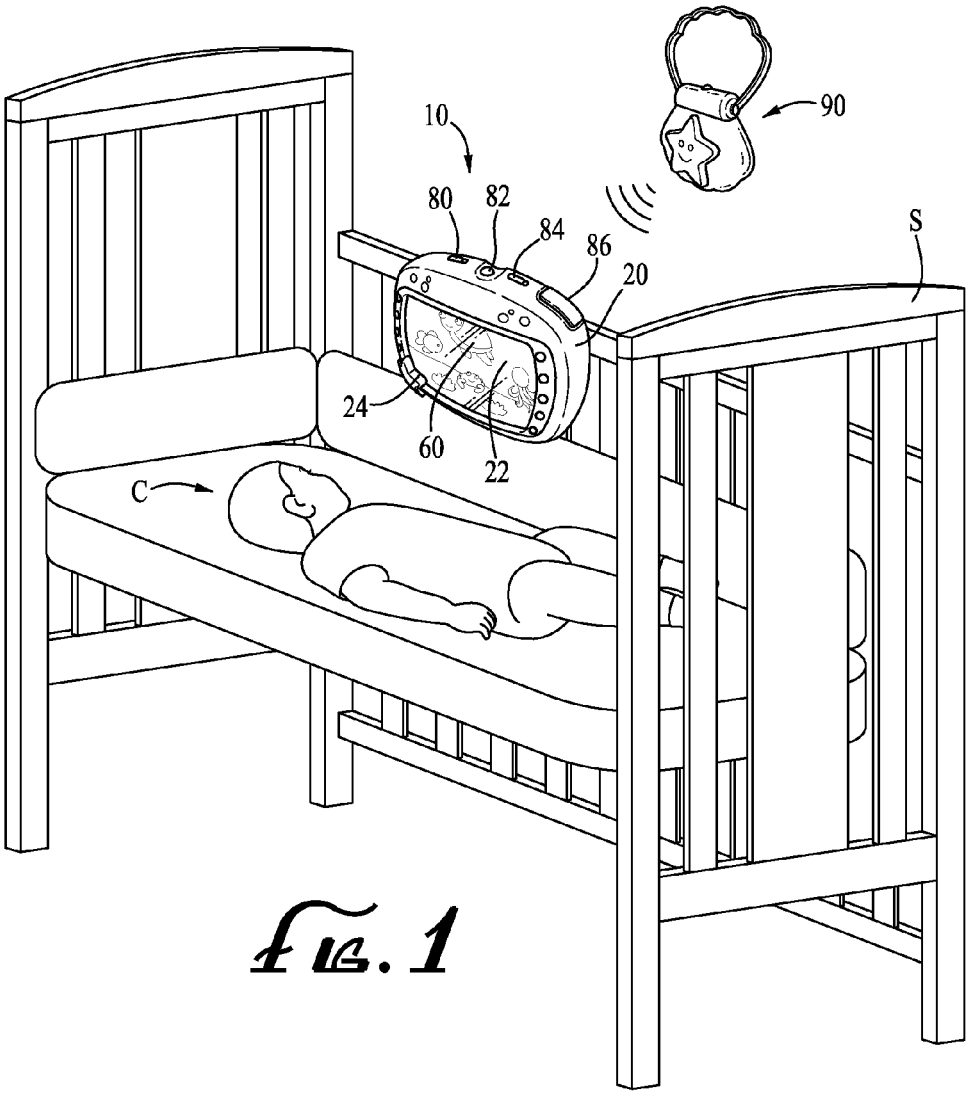
FIG. 1 is a perspective view of a crib soother device mounted to the frame of a child's crib according to an example embodiment of the present invention.
Figure 2A:
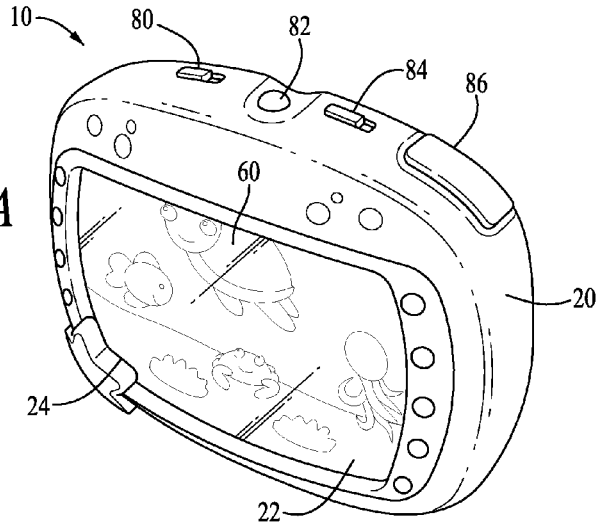
FIG. 2A is a front perspective view of the of the crib soother of FIG. 1.
Figure 2B:
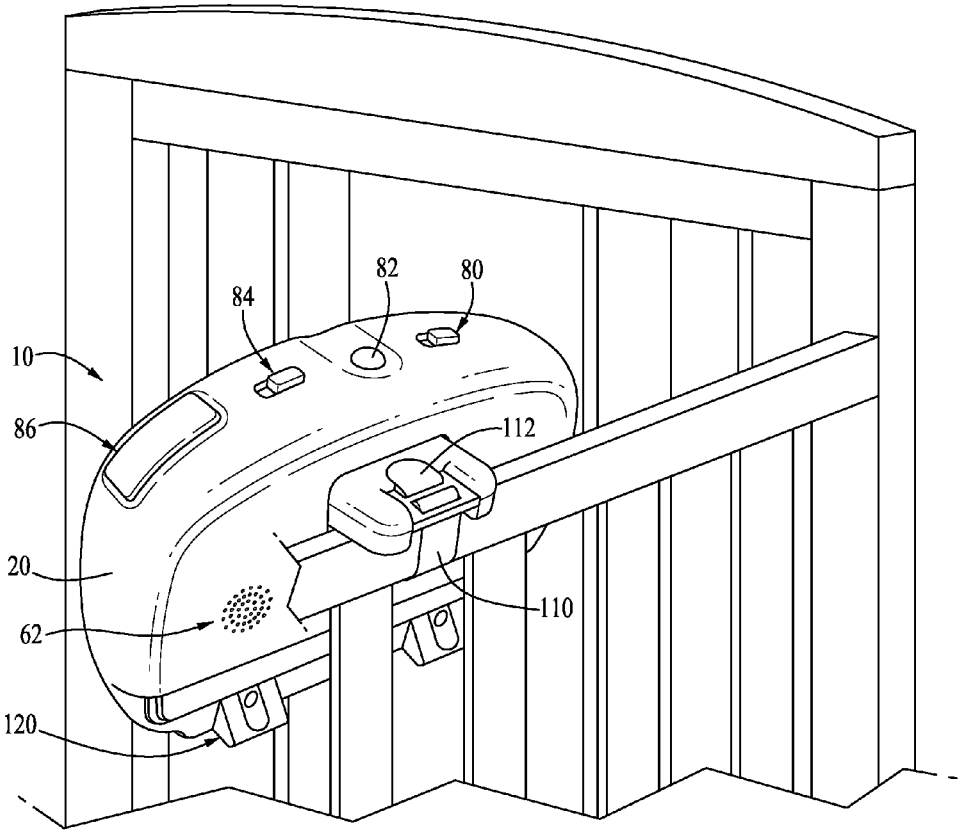
FIG. 2B is a perspective rear view of the of the crib soother of FIG. 1.
Figure 3A:
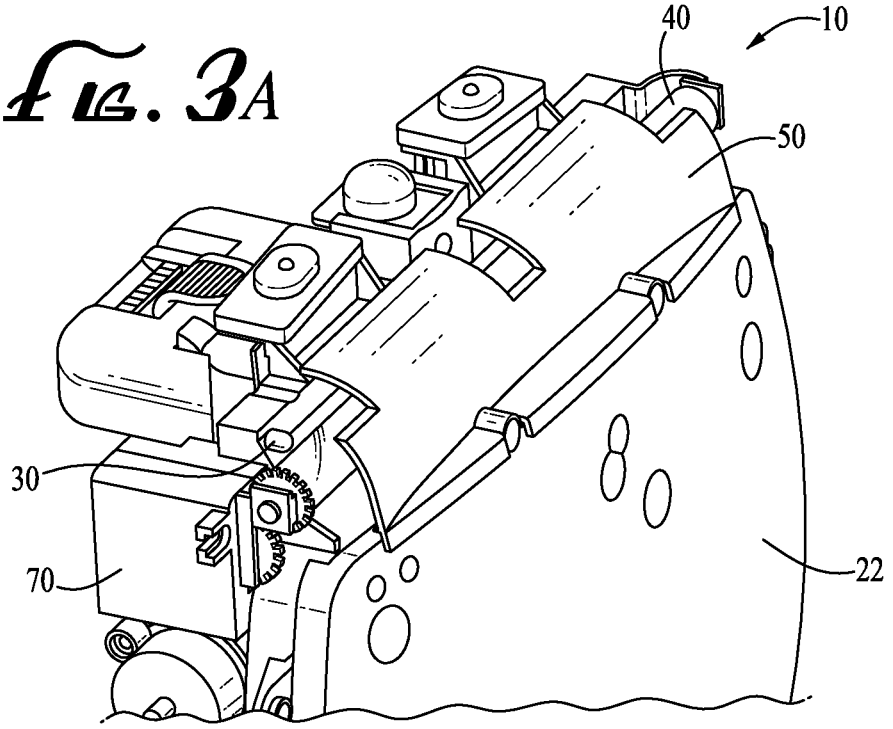
FIG. 3A is a partial assembly view of the crib soother of FIG. 1, with outer housing portions removed to show internal components thereof.
Figure 3B:
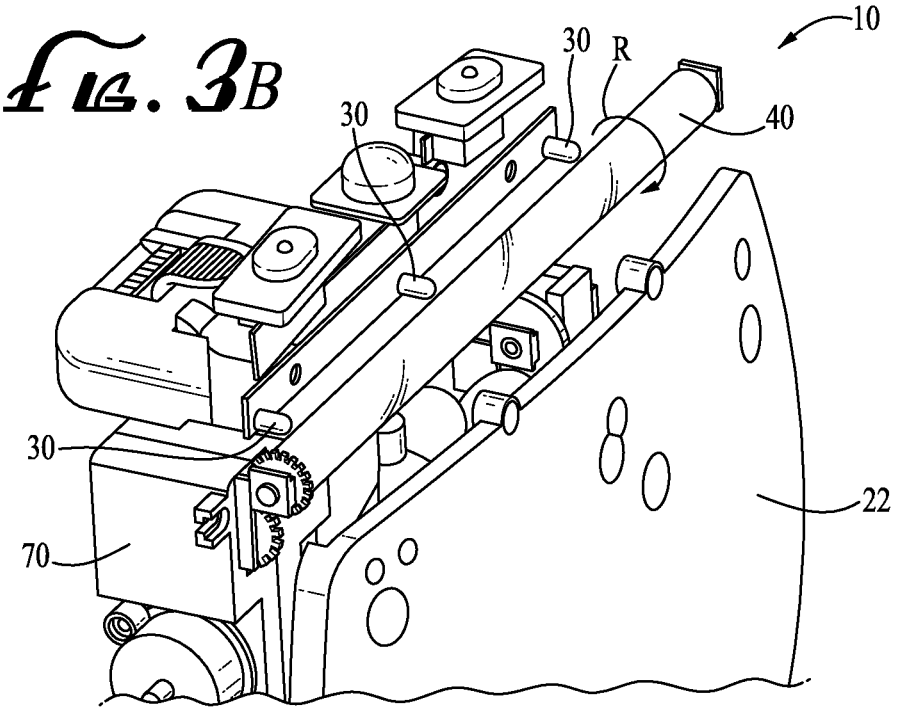
FIG. 3B is another partial assembly view of the crib soother of FIG. 1, with additional portions removed to show internal components thereof.

With reference now to the drawing figures, where like reference numbers refer to like part, FIGS. 1-3 show a crib soother device 10 according to an example form of the invention. The crib soother generally comprises an outer housing 20 with a display surface 22 visible through a window 24 thereof. The window 24 optionally comprises a transparent or translucent cover over the display surface 22, or optionally an opening in the housing 20. A light pattern or image is projected onto the display surface 22 by the projection of light from one or more light sources 30 through or onto an image bar 40, and onto the display surface 22. In the depicted embodiment, three LED light sources 30 are aligned in a generally linear array parallel to the lengthwise axis of the image bar 40. The image bar 40 is rotationally and/or translationally movable relative to the light source(s) 30, and comprises one or more image generating features thereon or therein, to produce a visible light pattern or image on the display surface 22. Optionally, a reflective mirror 50 or other optical element is interposed in the light path between the light source(s) 30 and the display surface 22, for example between the image bar 40 and the display surface 22. Alternatively, as shown in FIG. 4B, the display surface 22' is a portion of the housing, for example a translucent housing portion onto which a pattern or image is projected from the rear and visible from the front.

The soother device 10 optionally comprises one or more moving and/or stationary entertainment objects 60, such as, for example, molded characters or toys mounted along or adjacent to the display surface 22, and coupled to drive elements extending through the display surface 22 to impart rotational and/or translational movement of the objects 60 relative to the display surface 22. A drive motor 70 or other motive means optionally drives the motion of both the entertainment objects 60 and the image bar 40 through a transmission system and/or one or more linkages. Alternatively, separate drive means are provided for the entertainment objects 60 and the image bar 40. The device 10 optionally also generates audible sound patterns, via a sound transducer, sound files in onboard memory, and/or speaker or other audio output 62, optionally synchronized with the visible light patterns generated, to provide soothing audible and visual stimuli. One or more onboard controls 80, 82, 84, 86 are preferably provided to allow user operation to turn the device 10 on and off, adjust the volume, and/or selectively control the audio and/or the visible light patterns generated. A remote control 90 is optionally provided to allow a parent or caregiver to control operation of the soother device 10 from a remote location via wired or wireless (e.g., IR signal, Bluetooth, radio wave, etc.) communication. The soother 10 optionally also includes a toy or entertainment component that can be manually manipulated by a child, for example, one or more buttons that light up or make noise when pressed, hanging plush toys, a rotationally mounted ball with beads inside to be spun by the child, etc.

The soother device 10 can be mounted to a crib or other support structure S, for example by a mounting strap 110 or other mounting means. In alternate forms, the device is mounted to or adjacent a bassinet, play gym, play yard, or other equipment or resting area for a child C, infant or other human or animal user. In the depicted embodiment, the mounting strap 110 has a length adjustment clip 112 that selectively couples to and releases from the housing 20. Optionally, the device 10 further includes a base 120 having one or more support feet for supporting the device upon a bedside table or other support surface. The support base 120 can be removable from the housing, or can be integrally formed therewith.

Figure 4A:
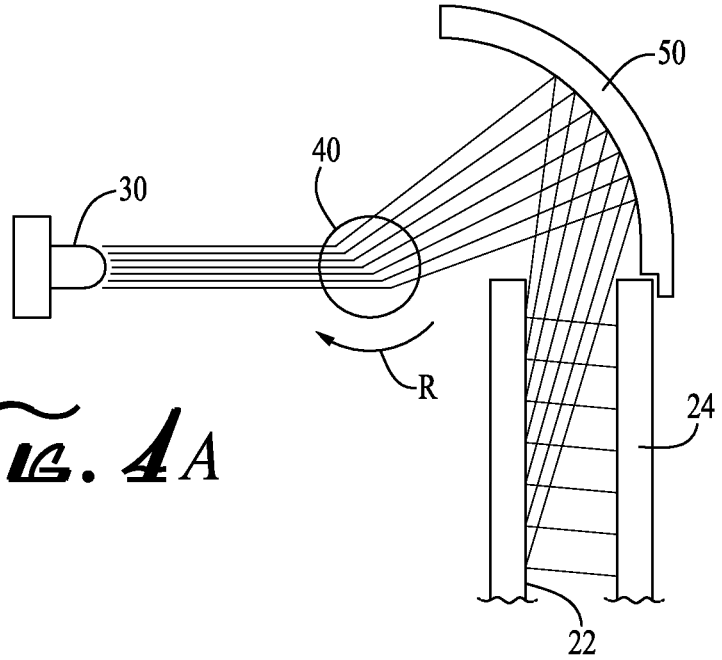
FIG. 4A is a schematic side view of a light source illuminating an image rod within the crib soother of FIG. 1, the light illuminating the image rod and projecting the light on a reflector that further projects the light on a display screen.
Figure 4B:
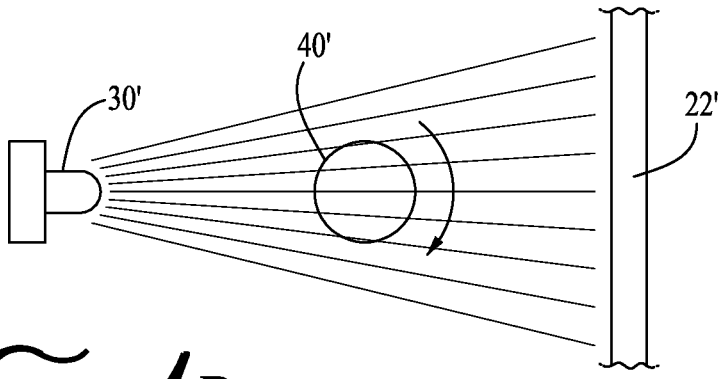
FIG. 4B is a schematic side view of a light source illuminating an image rod within a crib soother to generate a light pattern according to an additional example embodiment of the present invention.
Figure 5A:
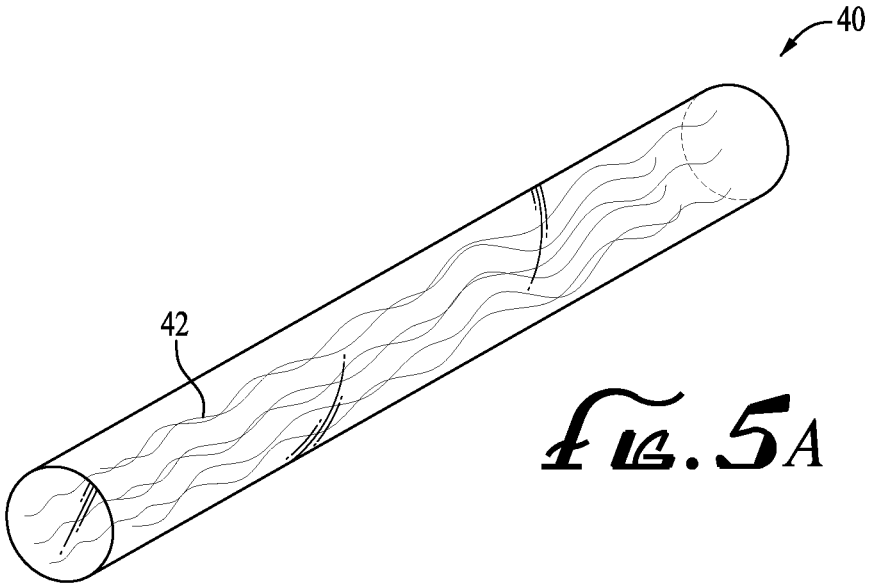
FIG. 5A is a perspective view of an image rod of a crib soother device according to an example form of the invention.
Figure 5B:
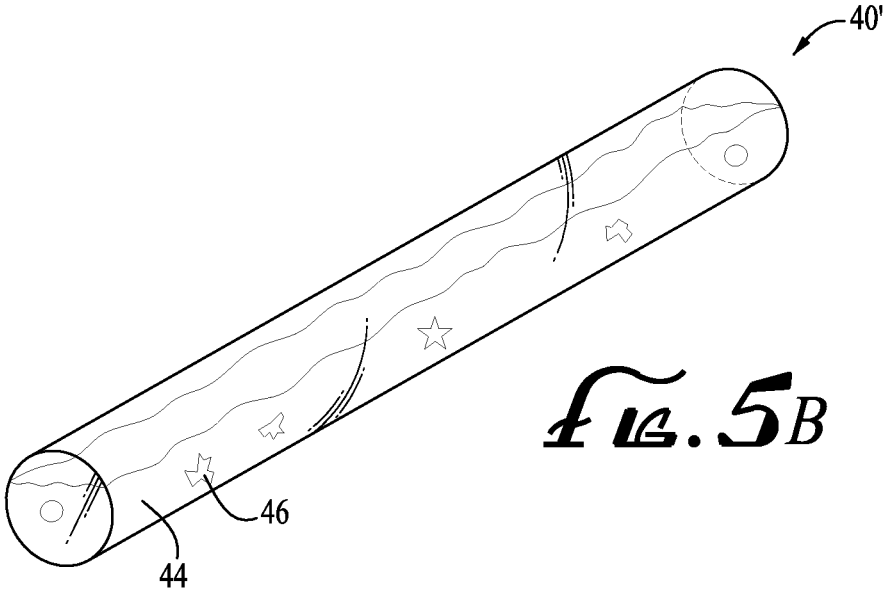
FIG. 5B is a perspective view of an image rod of a crib soother device according to another example form of the invention.

FIG. 4A shows a light transmission schematic of an example form of the soother device 10. Light (represented by linear rays) emitted from a light source 30 projects through the image bar 40, onto an arcuate reflector 50, to project an image or light pattern onto the display surface 22, which is visible through the window 24. The light bar 40 is rotated (indicated by arrow R), to vary the image or light pattern generated on the display surface 22. Example forms of image bar 40, 40' are shown in FIGS. 5A and 5B. The image bar 40 comprises a generally solid cylindrical elongate rod having a circular cross section. The alternative image bar embodiment 40' comprises a generally cylindrical hollow tube having material(s) and/or object(s) contained therein. The image bar 40, 40' is preferably formed from a transparent or translucent, or partially transparent or translucent, light-transmissive material, such as for example acrylic or ABS plastic. In alternate forms, the image bar is at least partially formed of a light-reflective material. In further alternate forms, the image bar has a shape other than cylindrical, for example an elongate triangular, rectangular or polygonal prismatic element, and/or includes one or more external surface features, inclusions or irregularities such as projections, ridges, holes or the like for varying light transmission and thereby affecting the light pattern generated.

One or more image or pattern generating features 42, 42' are provided in or on the image bar 40 to assist in generation of the visible light pattern or image, the pattern generating features 42, 42' having a different light transmissibility than the remainder of the body of the image bar 40. For example, in the embodiment of FIG. 5A, one or more translucent or opaque wave-shaped patterns 42 are applied to an external surface and/or formed into the image bar 40, for example by application of paint, label(s), frosting, tape, co-molding of optically different materials, cutting out of the bar, carving or etching into the bar, or other means. In the embodiment of FIG. 5B, the cylinder 40' contains a translucent or opaque liquid or granular material 44, and/or one or more pattern generating objects 46. Optionally, two or more immiscible liquid(s) and/or material(s), such as for example oil and water of different colors and/or different light transmissibility, water and sand particles, etc., are contained within the cylinder 40' to generate the image or light pattern upon transmission of light therethrough.

Application of one or more image or pattern generating features 42, 42' in or on the image bar 40 in a wavy or undulating pattern, for example one or more generally sinusoidal or irregular undulating wave patterns, applied about the circumference or peripheral surface of the image bar 40 results in generation of a moving pattern of light and shadow on the display surface, resembling a rippling water surface or the reflection of light from a rippling water surface when light is projected through the image bar onto a display surface and the image bar is moved relative to the light source. Such visible light patterns have been found to have a calming or relaxing effect on some infants, pacifying them and allowing them to sleep more easily.

In alternate embodiments, differing patterns may be provided for the image generating features 42, for example a zig-zag pattern, a helix or spiral pattern, a chevron pattern, a pattern of angularly offset elements, elements of different geometric shapes, or various other pattern formats. The light patterns or images generated by the image generating features 42 of the image bar may include any of a variety of moving characters, patterns, shapes, figures or the like, in addition to or instead of the rippling water patterns described above. In further example embodiments, two or more image bars may be operated in tandem, and/or interchangeable image bars can be provided for selective replacement and use. For example, a plurality of image bars can be provided in different locations and/or orientations, driven by one or more motor(s), projecting like or different image pattern(s) from one or more location(s) and/or projection angle(s) (e.g., projection from the top, bottom, left/right sides, and/or corners, etc.). The image bar(s) can be of a uniform color throughout, or can comprise two or more sections of differing colors or shades.

The light source(s) 30 can comprise one or more LEDs, incandescent or fluorescent lamps, or other light sources. The light source(s) 30 can be of a single uniform color, or alternatively of two or more differing colors, or variable color light sources. The light source(s) 30 can be operated at a constant light intensity, or alternatively can be varied between brighter and dimmer illumination states. Onboard batteries and/or an external AC power source can be utilized to energize the light source(s) 30 and the drive motor 70 for rotating the image bar 40 and actuating the entertainment objects 60. In further alternate embodiments of the invention, the light source(s) 30 and/or the reflector 50 may move, rather than (or in addition to) movement of the image bar 40.

In methods of use according to example forms of the invention, the soother device 10 is mounted to a crib or other support S, near a child C. The device 10 is activated by operation of the onboard controls 80, 82, 84, 86, and/or the remote 90. Light is transmitted through the image bar 40, and the image bar is rotated. Rotation of the image bar 40 causes variation of the light transmitted by the image bar, generating a fluctuating or wave-like image or pattern of light. The light pattern is reflected by the reflector 50 or otherwise projected onto the display surface 22, where it is visible by the child, and thereby may have a calming effect on the child and induce the child to more easily fall asleep. The image bar may be rotated at a constant or varying rotational speed, and/or can be controlled between two or more speed settings, to effect different patterns of light.

While the invention has been described with reference to preferred and example embodiments, it will be understood by those skilled in the art that a variety of modifications, additions and deletions are within the scope of the invention, as defined by the following claims.

What is claimed is:

1. A child soothing apparatus comprising a light source, an image bar, a housing, and a reflector, the light source, image bar and the reflector being contained within the housing, and the housing comprising an opening having a display surface within the housing and visible through the opening, the display surface comprising a front surface visible through the opening and a rear surface generally opposite the front surface and facing within the housing, the image bar being movable relative to the light source to generate a varying visible light pattern, the varying visible light pattern being projected onto the reflector and reflected onto the front surface of the display surface, the varying visible light pattern that is reflected onto the front surface of the display surface having a soothing effect on an observer.

2. The child soothing apparatus of claim 1, wherein the varying visible light pattern simulates moving water.

3. The child soothing apparatus of claim 1, wherein the varying visible light pattern simulates the reflection of light off of water.

4. The child soothing apparatus of claim 1, wherein the image bar comprises a body that is at least partially light transmissive, and further comprises at least one pattern generating feature having a different light transmissibility than the body of the image bar.

5. The child soothing apparatus of claim 1, further comprising a motor for rotationally driving the image bar.

6. The child soothing apparatus of claim 1, further comprising means for mounting the apparatus to a supporting element.

7. The child soothing apparatus of claim 1, further comprising at least one movable entertainment object.

8. The child soothing apparatus of claim 7, wherein movement of the at least one movable entertainment object is linked with movement of the image bar.

9. The child soothing apparatus of claim 1, further comprising an audio output for generating sound.

10. The child soothing apparatus of claim 1, further comprising a remote control for remote operation of the apparatus.

11. The child soothing apparatus of claim 1, wherein the image bar comprises a pattern applied to an external surface thereof.

12. The child soothing apparatus of claim 1, wherein the image bar comprises a hollow element, and at least one pattern generating material disposed within the hollow element.

13. The child soothing apparatus of claim 1, wherein the light source is stationary and the image bar moves.

14. The child soothing apparatus of claim 1, wherein the image bar is stationary and the light source moves.

15. The child soothing apparatus of claim 1, wherein the image bar comprises a body having at least one pattern generating feature cut out of the body.

16. The child soothing apparatus of claim 1, wherein the reflector is generally curved or arcuate in shape.

17. A soother device comprising:

a housing defining a window, wherein a display surface is positioned within the housing and visible through the window of the housing, the display surface comprising a front surface and a rear surface generally opposite the front surface, the front surface of the display surface being visible through the window;

a light source mounted within the housing;

an image bar rotationally mounted within the housing;

a motor for rotating the image bar; and a reflector, wherein light is transmitted from the light source through the rotating image bar to generate a light pattern, and wherein the light pattern is projected onto the reflector and reflected onto the front surface of the display surface.

18. The soother device of claim 17, wherein the light pattern simulates moving water or the reflection of light from water.

19. The soother device of claim 17, further comprising at least one entertainment object movable in conjunction with movement of the image bar.

20. The soother device of claim 17, further comprising means for mounting the apparatus to a supporting element.

21. The soother device of claim 17, further comprising an audio output for generating sound.

22. The soother device of claim 17, further comprising a remote control for remote operation of the device.

23. The soother device of claim 17, wherein the image bar comprises a pattern applied to an external surface thereof or cut out from the image bar.

24. The soother device of claim 17, wherein the image bar comprises a hollow element, and at least one pattern generating material disposed within the hollow element.

25. The soother device of claim 17, further comprising a toy that can be manually manipulated by a child.

26. The soother device of claim 17, wherein the reflector is generally arcuate in shape, and wherein with the image bar being positioned behind a front surface of the display surface, the changing light pattern projects from the image bar onto a concave area of the arcuate reflector, and projecting onto the front surface of the display surface.

27. A soother device comprising:

a plurality of light sources arranged in a generally linear array;

an elongate image bar defining a lengthwise axis generally parallel to the linear array of light sources, the image bar at least partially comprising a light transmissive material, and further comprising at least one pattern generating element having a different light transmissivity than the light transmissive material;

a motor for rotating the image bar about the lengthwise axis;

a housing defining a window therein;

a display surface comprising a front surface and a rear surface generally opposite the front surface, the display surface being within the housing and the front surface thereof being visible through the window of the housing; and a reflector, wherein light is emitted from the plurality of light sources, projected through the rotating image bar, and reflected by the reflector onto the front surface of the display surface to project a changing light pattern on the display surface.

28. The soother device of claim 27, wherein the light pattern simulates moving water or the reflection of light from water.

29. The soother device of claim 27, further comprising at least one entertainment object movable in conjunction with movement of the image bar.

30. The soother device of claim 27, further comprising means for mounting the apparatus to a supporting element.

31. The soother device of claim 27, further comprising an audio output for generating sound.

32. The soother device of claim 27, further comprising a remote control for remote operation of the device.

33. The soother device of claim 27, wherein the image bar comprises a pattern applied to an external surface thereof.

34. The soother device of claim 27, wherein the image bar comprises a hollow element, and at least one pattern generating material disposed within the hollow element.

35. The soother device of claim 27, wherein the reflector is generally curved or arcuate in shape.

* * * * *